US005870960A

United States Patent [19]

Brown

[11] Patent Number: 5,870,960

[45] Date of Patent: Feb. 16, 1999

[54] LOOPTAKER DRIVING ARRANGEMENT AND METHOD FOR ZIG-ZAG SEWING MACHINES

[75] Inventor: Jerry Don Brown, Troy, N.C.

[73] Assignee: Capel Incorporated, Troy, N.C.

[21] Appl. No.: 940,488

[22] Filed: Sep. 30, 1997

[51] Int. Cl.[6] ..... D05B 69/16; D05B 57/32

[52] U.S. Cl. ..... 112/220; 112/467

[58] Field of Search ..... 112/220, 467, 112/182, 190; 74/63, 69

[56] References Cited

U.S. PATENT DOCUMENTS

| | | | |
|---|---|---|---|
| 1,159,523 | 11/1915 | Miller . | |
| 2,244,424 | 6/1941 | Mahany | 112/467 X |
| 2,690,723 | 10/1954 | Sudo . | |
| 2,765,759 | 10/1956 | Attwood et al. | 112/220 |
| 2,932,268 | 4/1990 | Johnson . | |
| 3,490,401 | 1/1970 | Hamlett . | |
| 3,515,043 | 6/1970 | Austin . | |
| 3,590,702 | 7/1971 | Sechi . | |
| 3,779,187 | 12/1973 | Adams . | |
| 3,783,810 | 1/1974 | Marforio . | |
| 3,804,042 | 4/1974 | Ross . | |
| 4,357,887 | 11/1982 | Hara et al. . | |
| 4,662,292 | 5/1987 | Kioke et al. . | |
| 4,674,423 | 1/1987 | Koike et al. . | |
| 4,702,183 | 10/1987 | Greasley et al. | 112/190 X |
| 4,924,788 | 5/1990 | Brown . | |
| 5,549,061 | 8/1996 | Oda et al. | 112/220 |

*Primary Examiner*—Ismael Izaguirre
*Attorney, Agent, or Firm*—Kennedy Covington Lobdell & Hickman LLP

[57] ABSTRACT

A looptaker driving arrangement in a zig-zag sewing machine includes: a rotatable drive shaft driving rotation of the looptaker of the sewing machine; a main drive member rotatably supported on the drive shaft; a secondary drive member fixed on the drive shaft for concurrent rotation therewith; a bushing rotatably mounted on the drive shaft with an eccentric outer periphery; and a coupling member rotatably mounted on the periphery of the bushing in eccentric relation to the drive shaft and engaging the main drive member and the secondary drive member. Rotation of the main drive member about the drive shaft axis combined with rotation of the bushing about the drive shaft axis relative to the main drive member angularly accelerates and decelerates the secondary drive member with respect to the main drive member and, in turn, angularly accelerates and decelerates the drive shaft. A gear arrangement provided for driving rotation of the bushing about the drive shaft axis relative to the main drive member includes: a first gear fixed to the drive shaft; a pair of connected gears rotatably mounted to the sewing machine; and a second gear fixedly connected to the bushing and rotatably supported on the drive shaft in coaxial relation thereto. The first gear meshingly engages a first one of the pair of gears and the second gear meshingly engages a second one of the pair of gears, whereby rotation of the drive shaft rotates the bushing about the drive shaft axis relative to the main drive member.

18 Claims, 5 Drawing Sheets

LOOPTAKER DRIVING ARRANGEMENT AND METHOD FOR ZIG-ZAG SEWING MACHINES

BACKGROUND OF THE PRESENT INVENTION

The present invention relates generally to sewing machines of the type wherein a thread-carrying needle is laterally shifted to form sewn stitches in a zig-zag pattern and, more particularly, relates to an arrangement for optimally positioning a hook of a looptaker of the sewing machine relative to laterally shifted loop-forming positions of the needle.

Sewing machines capable of forming an ornamental chain of lock stitches in laterally-shifting, zig-zag pattern are well known and in widespread commercial use. In a typical commercial zig-zag sewing machine, the thread-carrying needle is driven from a main drive shaft of the machine through intermediary eccentric cam mechanisms to reciprocate vertically upwardly and downwardly through a throat plate in a stitching bed of the machine frame while the needle is laterally shifted leftwardly and rightwardly in alteration in timed relation to the vertical reciprocatory movements of the needle. A looptaker having a peripheral hooked beak portion, commonly referred to as a hook, is rotatably driven beneath the throat plate in parallel relation to the laterally shifting movements of the needle by a secondary drive shaft driven from the main drive shaft in timed relation to the needle reciprocating vertical and laterally shifting movements. A thread-carrying bobbin is mounted stationarily alongside the looptaker. In operation, upon the completion of each downward stroke of the needle, a loop of the thread carried by the needle is formed as the needle begins its upward stroke, the timing of the rotation of the looptaker in relation to the needle being such that the hook of the looptaker seizes the loop and carries it around the bobbin to lock stitch the threads of the needle and bobbin together.

A long-standing and widely recognized problem in the operation of zig-zag sewing machines of the aforementioned type is that, since the looptaker is conventionally rotated at a constant angular speed about a fixed axis, the looptaker cannot present the hook in an optimal disposition with respect to the needle at both the laterally shifted leftward and rightward positions of the needle. Accordingly, it is conventional practice to coordinate the rotation of the looptaker with respect to the needle reciprocation as though the needle were being reciprocated in a non-shifting straight stitch position equidistant the leftward and rightward shifted needle positions for the zig-zag stitch. In this manner, the hook is equally out of optimal timed relationship with the needle at each of the needle's leftwardly and rightwardly shifted positions, whereby the hook prematurely takes the thread loop when the needle is shifted rightwardly in the direction towards the approaching hook and likewise is delayed in taking the loop when the needle is shifted leftwardly in the opposite direction away from the approaching hook. While the sewing machine is "acceptably" operable in this manner, missed stitches, broken needles, and prematurely worn hooks do occur.

Various proposals have been made to regulate the depth of needle penetration through the throat plate with respect to the hook to compensate for the shifted positions of the needle to improve the timing of the needle with respect to the hook, as representatively disclosed in U.S. Pat. Nos. 1,159,523; 2,932,268; and 3,779,187. However, none of these arrangements are known to have met with any significant degree of commercial acceptance and success. In other types of zig-zag sewing machines, the looptaker or other looper device is arranged for lateral shifting in timed relation to the lateral shifting of the needle to achieve proper relative timing, as representatively disclosed in U.S. Pat. Nos. 2,690,723; 3,490,401; and 3,783,810. It is also known in another type of zig-zag sewing machine to provide a cam-controlled mechanism for intentionally producing a pattern of missed stitches by selectively advancing or retarding rotation of the looptaker out of timed relationship with respect to the needle, as disclosed in U.S. Pat. No. 3,804,042.

Finally, it is also known to angularly accelerate and decelerate the looptaker in timed relation to the shifting movements of the needle to position the hook of the looptaker in optimal relationship to the needle at each shifted position thereof, as disclosed in U.S. Pat. No. 4,924,788. While this latter technique is considered superior to the aforementioned proposals, there still remains a potential for further improvement over the angular acceleration and deceleration arrangements disclosed in this particular patent.

BRIEF SUMMARY OF THE PRESENT INVENTION

It is accordingly an object of the present invention to provide an improved looptaker driving arrangement and method for use in a zig-zag sewing machine of the above-described type to drive rotation of the looptaker in timed relation to shifting movements of the needle to position the hook of the looptaker in optimal relationship to the needle at each laterally shifted position thereof The present invention is basically adapted for incorporation in essentially any zig-zag sewing machine having a thread-carrying needle, a needle manipulating mechanism for reciprocating the needle longitudinally to form thread loops and for shifting the needle laterally between spaced first and second loop-forming positions to distribute the thread loops in zig-zag pattern, a looptaker rotatable about a fixed axis and having a hook for cooperating with the needle to seize the thread loops, and a drive shaft for rotating the looptaker.

Briefly summarized, the present invention includes: a drive shaft supported underneath the sewing machine for rotation about a longitudinal axis thereof, with rotation of the drive shaft driving rotation of the looptaker of the sewing machine; a main drive member supported on the drive shaft in movable relation thereto and rotatable about the drive shaft axis; a secondary drive member mounted to the drive shaft in fixed relation and rotatable therewith about the drive shaft axis; and a coupling member supported by the drive shaft in movable relation thereto and rotatable about the drive shaft axis and about an axis parallel to the drive shaft axis, with the coupling member engaging through abutment the main drive member and engaging through abutment the secondary drive member for coupling movement of the main drive member with the secondary drive member. Rotation of the main drive member about the drive shaft axis causes rotation of the secondary drive member and the drive shaft about the drive shaft axis thereby driving rotation of the looptaker.

In the preferred embodiment, the main drive member includes a drive rod which is mounted to a drive pulley, and the secondary drive member includes a drive rod which is mounted to an anchor member secured to the drive shaft.

In a further feature of the present invention, the bushing is supported on the drive shaft in eccentric axial relation thereto and rotatable about the drive shaft axis, with the coupling member being rotatably supported on the bushing.

In another feature, the present invention includes a gear arrangement for driving rotation of the bushing relative to the drive shaft about the drive shaft axis. In particular, the gear arrangement preferably includes: a first gear fixedly supported on the drive shaft in coaxial relation thereto and rotatable therewith about the rotational axis thereof; a pair of gears mounted to a frame of the sewing machine; and a second gear fixedly mounted to the bushing in coaxial relation to the drive shaft and rotatable about the drive shaft axis. The first gear meshingly engages a first one of the pair of gears and the second gear meshingly engages a second one of the pair of gears, with the pair of gears being fixedly joined together for simultaneous rotation. Furthermore, four complete revolutions of the first gear about the drive shaft axis with respect to the sewing machine preferably results in three complete revolutions of the second gear about the drive shaft axis with respect to the sewing machine.

In yet a further feature of the present invention, the coupling member is H-shaped having two opposing channels. The main drive member is received in engaging abutment in a first one of the channels and the secondary drive member is received in engaging abutment in a second one of the channels. Furthermore, the coupling member is disposed in slidable and pivotable engagement with both the main drive member and the secondary drive member.

In operation, rotation of the bushing about the drive shaft axis relative to the drive shaft causes the coupling member to pivot in oscillating manner about the main drive member thereby causing the secondary drive member to oscillate in an arcuate path about the drive shaft axis. The looptaker is thus angularly accelerated and decelerated about a constant angular speed of the main drive member by this pivoting of the H-shaped coupling member. The method of the present invention includes rotating the bushing about the drive shaft axis relative to the drive shaft and rotating the main drive member about the drive shaft axis, whereby the bushing is rotated three times about the drive shaft axis relative to frame of the sewing machine each time the main drive member is rotated four times about the drive shaft axis relative to the frame of the sewing machine.

DETAILED DESCRIPTION OF THE PREFERRED METHOD AND APPARATUS

Figure 1:
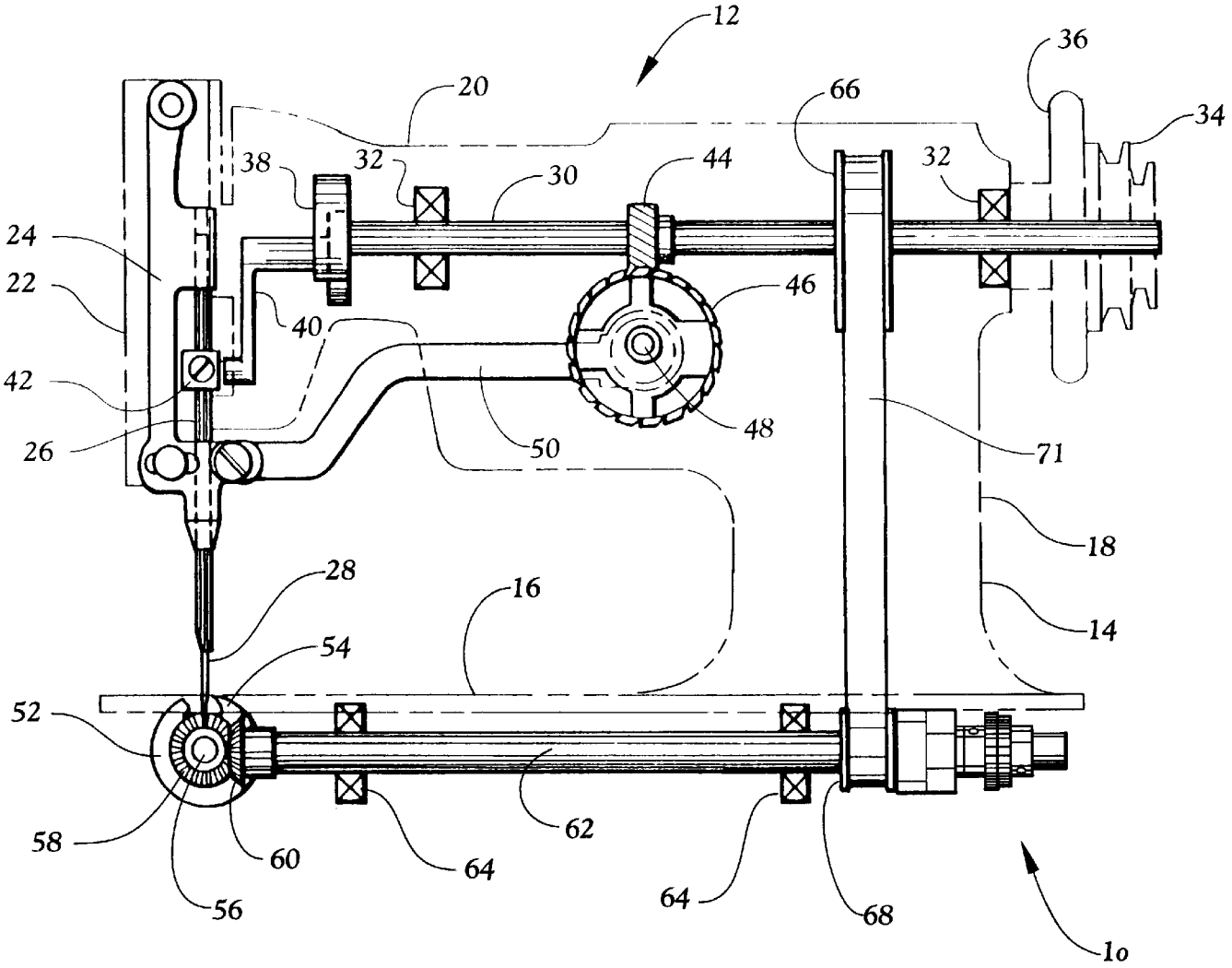
FIG. 1 is a front elevational view of the mechanical working components of a conventional zig-zag sewing machine, the frame of which is shown in phantom lines, incorporating a preferred embodiment of the looptaker driving arrangement of the present invention.

With reference initially to FIG. 1, the preferred embodiment of the looptaker driving arrangement of the present invention is indicated generally at 10 as preferably embodied in an otherwise conventional sewing machine of the zig-zag lock stitch type, indicated generally at 12. By way of example and without limitation, the illustrated zig-zag sewing machine is representative of the SINGER brand sewing machine Model No. 107W3 manufactured by The Singer Company of New York, N.Y., or the YAMATO brand machine Model No. DP3 manufactured by Yamato Sewing Machine Manufacturing Co. Ltd. of Japan. Of course, as those persons skilled in the art will recognize, the present invention may be equally well adapted for use in other types of zig-zag sewing machines. Inasmuch as the construction and operation of the SINGER and YAMATO machines are well known within the art, the sewing machine 12 is illustrated and described herein only to the extent necessary to facilitate understanding of the present invention.

As seen in FIG. 1, the sewing machine 12 has a substantially hollow structural frame 14, shown only in phantom, which includes a horizontal machine bed 16, an upstanding arm 18 extending from the rightward end of the bed 16, and a horizontal arm 20 extending from the upright arm 18 and terminating in a sewing head 22 spaced directly above the bed 16. A needle bar frame 24 is pivotally supported within the sewing head 22 for relative swinging movement leftwardly and rightwardly, as viewed in FIG. 1, and a needle bar 26 having a sewing needle 28 affixed to its depending end is slidably supported by the needle bar frame 24 for vertical movement upwardly and downwardly relative thereto.

A main drive shaft 30 is rotatably supported by bearings 32 to extend horizontally through the hollow horizontal arm 20 of the machine frame 14. The rightward end of the drive shaft 30 extends outwardly from the frame 14 and has a drive pulley arrangement 34 fixed to the exposed end of the drive shaft 30 to facilitate driven operation thereof from any suitable power source. A hand wheel 36 is also fixed to the exposed extent of the drive shaft 30 for manual operation thereof The opposite end of the drive shaft 30 carries a counterweight 38, one end of a crank arm 40 being pivotally mounted eccentrically to the counterweight 38 with its opposite end being affixed by a connecting bracket 42 to the needle bar 26 for reciprocating the needle bar 26 vertically upwardly and downwardly with respect to the needle bar frame 24. A spiral pinion gear 44 is affixed to the main drive shaft 30 at an intermediate location in meshing engagement with another spiral gear 46 mounted on a perpendicular shaft 48 supported by the machine frame 14 immediately below the pinion gear 44. A drive bar 50 is mounted eccentrically at one end to the spiral gear 46 and is connected at the opposite end to the needle bar frame 24 to drive reciprocating leftward and rightward swinging movement of the needle bar frame 24 (as viewed in FIG. 1). In this manner the main drive shaft 30 controls vertical reciprocating movement and lateral shifting movement of the needle 28 for stitch formation in conventional fashion.

The bed 16 of the machine frame 14 includes a throat plate (not shown) immediately beneath the assembly of the needle bar frame 24 and the needle bar 26 to define a stitching work area through which the needle 28 is permitted to penetrate the bed 16. Immediately beneath the throat plate, a looptaker 52 having a beaked hook portion 54 at its outer periphery, such unit sometimes being commonly referred to in its entirety as a hook, is fixed in conventional manner to a shaft 56 rotatably supported by the bed 16 for rotational movement of the looptaker 52. A bevel gear 58 is mounted coaxially on the shaft 56 in meshing engagement with another bevel gear 60 mounted at the leftward end of a secondary drive shaft 62 rotatably supported by bearings 64 horizontally along the underside of the bed 16.

Figure 3A:
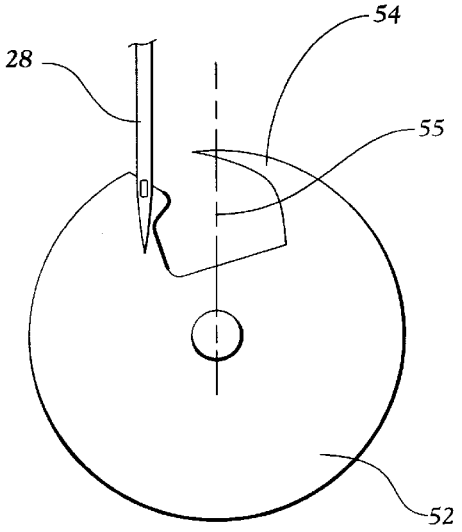
Fig. 3A PRIOR ART
FIGS. 3A and 3B are relatively enlarged side elevational views representively showing the relative positions of the needle and rotating hook in the sewing machine of FIG. 1 at the leftwardly and rightwardly shifted loop-forming positions of the needle as timed according to conventional prior art practice.
Figure 3B:
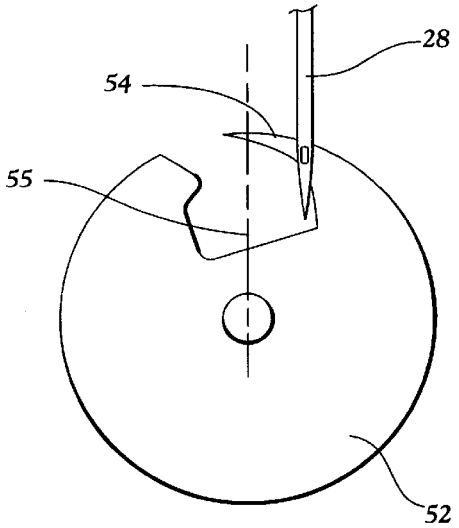
Fig. 3B PRIOR ART

Conventionally, the secondary drive shaft 62 is belt-driven from the main drive shaft 30 in timed relation therewith via appropriate speed-change pulleys fixed respectively to the main and secondary drive shafts 30, 62, whereby the secondary drive shaft 62 and, in turn, the looptaker 52 are driven at a constant angular speed. Furthermore, as is conventional, the drive train of the looptaker 52 is provided with appropriate gearing to drive rotation of the looptaker 52 to perform two full revolutions for each downward stitching reciprocation of the needle 28 to lock-stitch each loop of the needle-carried thread with respect to the bobbin-carried thread in a known manner. As aforementioned, however, timing problems arise with this arrangement because the laterally shifting movements of the needle 28 cause the needle to be alternatively disposed upon completing its downward reciprocation at spaced loop-forming stitch positions at opposite lateral sides of the rotational axis of the looptaker 52, while in contrast the hook 54 of the looptaker 52 is at the same angular disposition in its path of rotational movement when the needle 28 is at each of its loop-forming stitch positions because the looptaker 52 is rotated at a constant angular speed about a fixed axis defined by the shaft 56. This inherent mistiming of the hook 54 and the needle 28 is illustrated in FIGS. 3A and 3B, wherein only the needle 28 and looptaker 52 are shown from the same front elevation as in FIG. 1. In FIG. 3A, the needle 28 is illustrated at its leftwardly shifted loop-forming stitch position, while in FIG. 3B the needle 28 is illustrated at its rightwardly shifted loop-forming stitch position. In each case, the looptaker 52 is shown at the identical rotational disposition with its hook 54 passing through the uppermost extent of its counter-clockwise rotational path of movement immediately beneath the throat plate (not shown). Thus, in the leftwardly shifted stitch position of the needle 28, the needle 28 has been shifted generally in the same direction as the counter-clockwise rotational path of the hook 54 and, therefore, the hook 54 is delayed in reaching a loop-seizing disposition passing the needle 28, as seen in FIG. 3A. Similarly, as seen in FIG. 3B, at the rightwardly shifted stitch position of the needle 28, the needle 28 has been shifted in a direction essentially opposite the rotational path of the hook 54 and, therefore, the hook 54 passes prematurely through a loop-seizing position adjacent the needle 28. Conventionally, as also aforementioned, the looptaker 52 is timed with respect to the needle 28 to orient the hook 54 in proper loop-seizing disposition with respect to an imaginary "neutral" needle reciprocating path 55 which the needle 28 would follow if it were not shifted laterally, shown in phantom lines in each of FIGS. 3A and 3B, which causes the needle 28 and the hook 54 to be equally out of time at each stitch position of the needle. So long as the extent of laterally shifting movement of the needle 28 is not too great, the sewing machine will still perform a zig-zag lock stitching operation, but the mistiming between the needle 28 and the hook 54 produces an undesirable amount of contact between these components causing premature wear and frequent needle breakage and additionally causing a greater than desirable frequency of missed stitches.

Figure 4A:
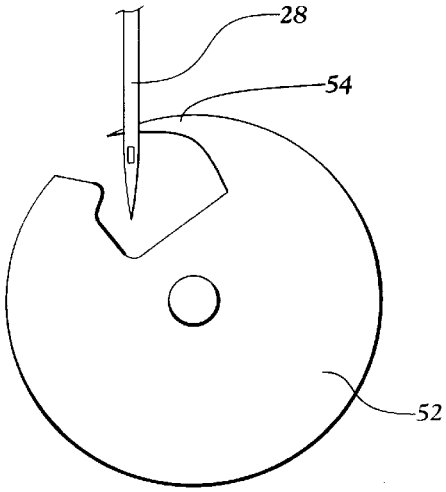
FIG. 4A and 4B are corresponding side elevational views of the needle and hook showing their relative dispositions at the leftward and rightward loop-forming needle positions when the looptaker is driven by the looptaker driving arrangement of the present invention.
Figure 4B:
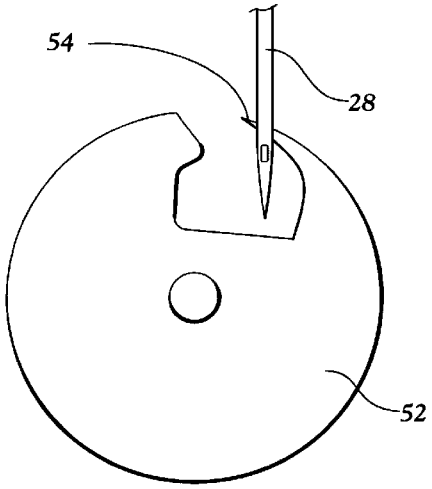

In contrast, the improved looptaker driving arrangement 10 of the present invention provides drive arrangement by which the secondary drive shaft 62 and, in turn, the looptaker 52 are accelerated when the needle 28 is shifted to its leftward loop-forming stitch position so as to advance the hook 54 of the looptaker 52 into a loop-seizing disposition in optimal relation with respect to the needle 28, as shown in FIG. 4A. Likewise, the secondary drive shaft 62 and the looptaker 52 are decelerated when the needle 28 is in its rightward loop-forming stitch position to retard the hook 54 of the looptaker 52 into a loop-seizing disposition also optimally related with respect to the needle 28, as shown in FIG. 4B. This optimal positioning of the hook 54 with respect to the laterally shifted needle positions as shown in FIGS. 4A and 4B will now be described in detail.

As best seen in FIG. 1, a first drive pulley 66 is fixed to the main drive shaft 30 and a speed-change second drive pulley 68 is rotatably mounted on the secondary drive shaft 62, with an endless drive belt 71 being trained about the pulleys 66, 68. The drive pulleys 66,68 are identical to the drive pulleys utilized in a conventional sewing machine as described above except that the drive pulley 68 is supported in movable relation to the secondary drive shaft 62 for rotation about the drive shaft axis 72 rather than being fixed to the drive shaft 62. For instance, the pulleys 66, 68 are sized to accomplish the aforementioned speed change to produce four revolutions of the looptaker 52 for every pair of stitch-forming reciprocations of the needle 28, as is conventional.

Figure 2:
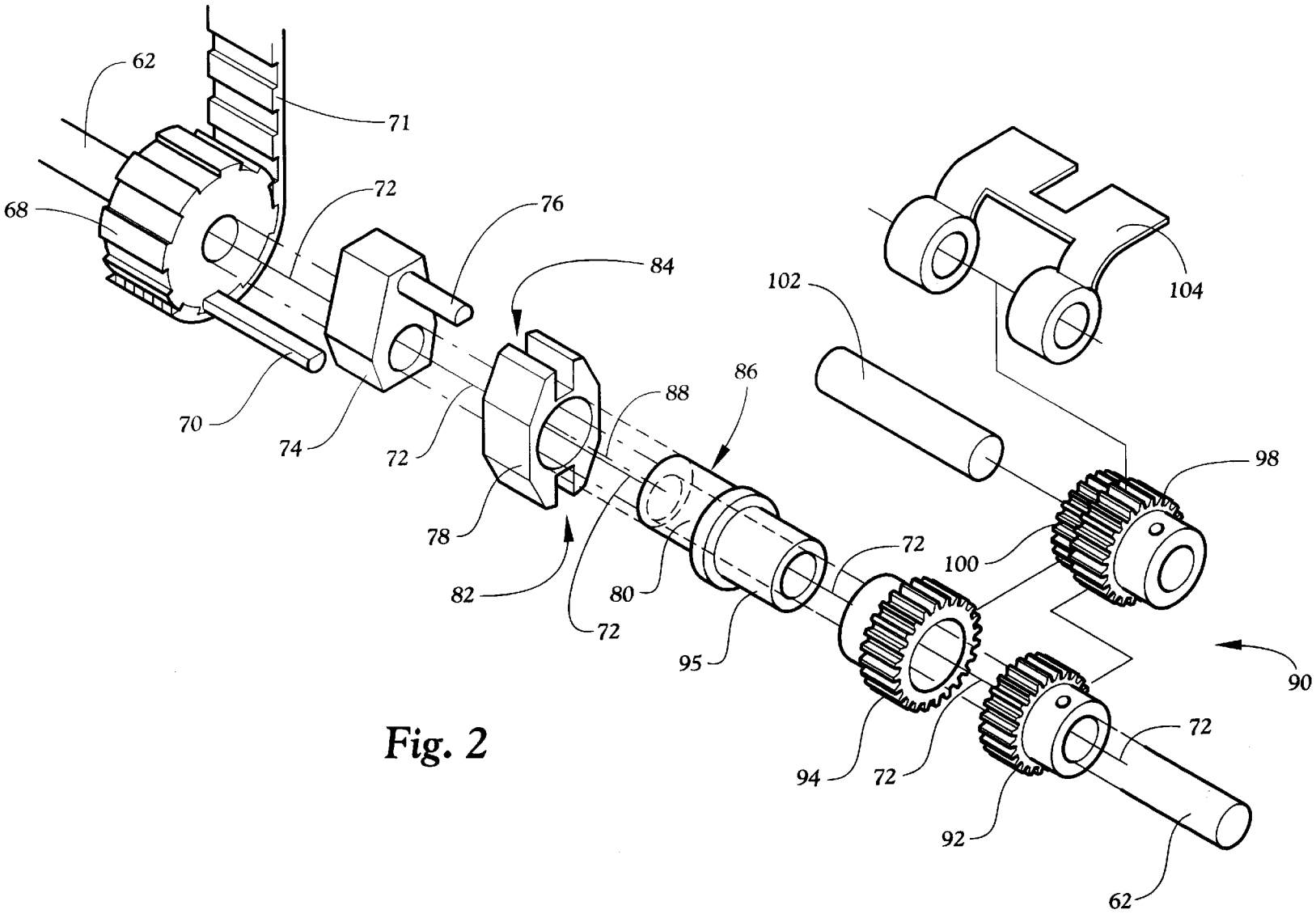
FIG. 2 is an exploded perspective view of the improved looptaker driving arrangement of FIG. 1.

As best seen in FIG. 2, the second drive pulley 68 includes a main drive rod 70 fixedly mounted to the second drive pulley 68 and extending therefrom parallel to the secondary drive shaft 62 for orbital movement of the the main drive rod 70 about the longitudinal axis 72 of the secondary drive shaft 62 upon rotation of the secondary drive pulley 68. Disposed adjacent the second drive pulley 68 and fixed to the secondary drive shaft 62 is an anchor member 74 with a secondary drive rod 76 fixedly mounted thereto and extending therefrom parallel to the secondary drive shaft 62 for similar orbital movement by the secondary drive rod 76 about the rotational axis 72 of the secondary drive shaft 62.

An H-shaped coupling member 78 is supported by secondary drive shaft 62 adjacent the anchor member 74 and, in particular, is rotatably mounted on a bushing 80 which itself is rotatably mounted on the secondary drive shaft 62 adjacent the anchor member 74. The H-shaped coupling member 78 includes two diametrically opposed channels 82, 84 each for receiving in engaging abutment main drive rod 70 and secondary drive rod 76, respectively. Furthermore, the H-shaped coupling member 78 slidably and pivotally engages the drive rods 70, 76 for movement relative thereto as will be explained presently.

The bushing 80 includes an outer circular surface 86 concentric about an axial centerline 88 which is offset from but parallel to the axial centerline 72 of the secondary drive shaft 62 when mounted thereon. Thus, the bushing 80 is rotatably supported on the secondary drive shaft 62 in eccentric axial relation thereto. The H-shaped coupling member 78, rotatably mounted on the circular surface 86 of the bushing 80, is thus rotatable with the bushing 80 about the rotational axis 72 of the secondary drive shaft 62 as well as rotatable about the axis 88 of the circular surface 86 eccentric to the rotational axis 72 of the secondary drive shaft 62.

The bushing 80 is continuously driven to rotate about the secondary drive shaft axis 72 relative to the secondary drive shaft 62, as more fully described hereinafter. By virtue of such rotation of the bushing 80 and the driven rotation of the drive pulley 68, the drive pulley 68 and the anchor member 74 with their respective drive rods 70, 76, and the bushing 80, each move relative to one another during ongoing operation of the sewing machine. In particular, four representative positions I–IV in the relative rotation of the drive pulley 68 and its drive rod 70, the anchor member 74 and its drive rod 76, and the bushing 80 about the rotational axis 72 are schematically shown in FIGS. 5A–5D. In position I of FIG. 5A, the axial centerline 88 of the circular surface 86 of the bushing 80 is located vertically below the rotational axis 72 of the secondary drive shaft 62. In this position, the main drive rod 70, the secondary drive rod 76, and the rotational axis 72 of the secondary drive shaft 62 vertically align. In position II of FIG. 5B, the axial centerline 88 of the circular surface 86 of the bushing 80 is located horizontally to the left from the rotational axis 72 of the secondary drive shaft 62. In this position, the main drive rod 70 and the secondary drive rod 76 do not align with the rotational axis 72 of the secondary drive shaft 62. In position III of FIG. 5C, the axial centerline 88 of the circular surface 86 of the bushing 80 is located vertically above the rotational axis 72 of the secondary drive shaft 62. In this position, the main drive rod 70, the secondary drive rod 76, and the rotational axis 72 of the secondary drive shaft 62 again vertically align. Finally, in position IV of FIG. 5D, the axial centerline 88 of the circular surface 86 of the brushing 80 is located horizontally to the right from the rotational axis 72 of the secondary drive shaft 62. In this position, the main drive rod 70 and the secondary drive rod 76 do not align with the rotational axis 72 of the secondary drive shaft 62.

In each of the positions I–IV of the bushing 80 shown in FIGS. 5A–5D, the orbital movement of the centerline 88 of the circular surface 86 of the bushing 80 relative to the rotational axis 72 of the secondary drive shaft 62 has both vertical and horizontal components of movement as indicated by the arrows V, H in FIG. 5A–5D. Moreover, because the H-shaped coupling member 78 is mounted on the circular surface 86 of the bushing 80, it too undergoes the same vertical and horizontal movement shown by arrows V, H as schematically shown in FIGS. 6A–6D.

Figure 6A:
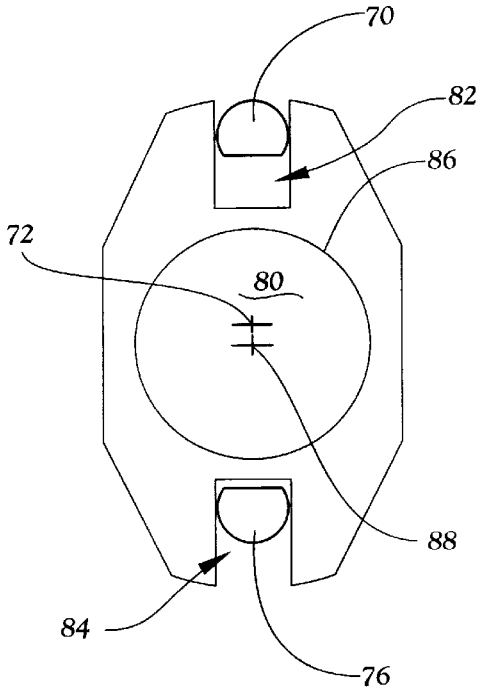
FIG. 6A is a schematic representation of the H-shaped coupling member when the bushing in position I with respect to the main drive member and secondary drive member as shown in FIG. 5A.

Thus, in position I of the H-shaped coupling member 78 as schematically shown in FIG. 6A, the channels 82, 84 are vertically aligned with the axial centerline 88 of the circular surface 86, with the main drive rod 70 disposed in channel 82 of the H-shaped coupling member at its greatest radial spacing outwardly from the axial centerline 88 of the circular surface 86, and with the secondary drive rod 76 disposed in channel 84 at its closest radial spacing inwardly to the axial centerline 88 of the circular surface 86.

Figure 5A:
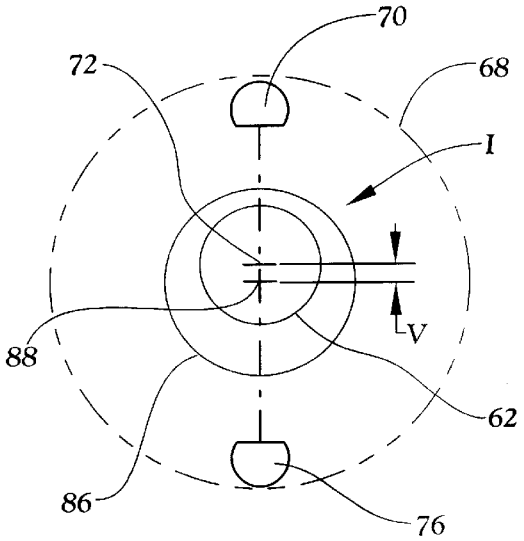
FIG. 5A is a schematic representation of a first position (position I) in the rotation of the bushing about the secondary drive shaft of FIG. 1 with respect to the main drive member and secondary drive member.
Figure 5B:
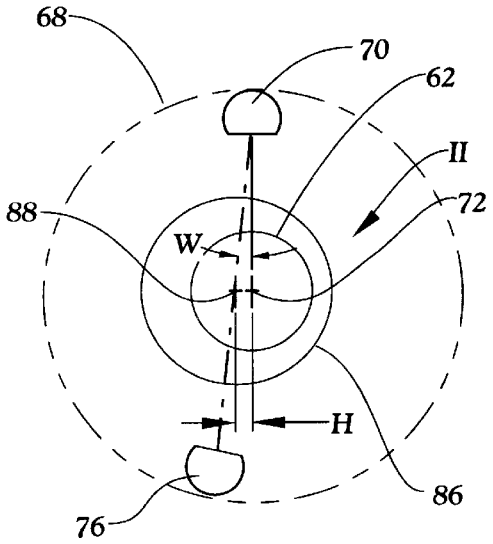
FIG. 5B is a schematic representation of a second position (position II) in the rotation of the bushing about the secondary drive shaft of FIG. 1 with respect to the main drive member and secondary drive member.
Figure 5C:
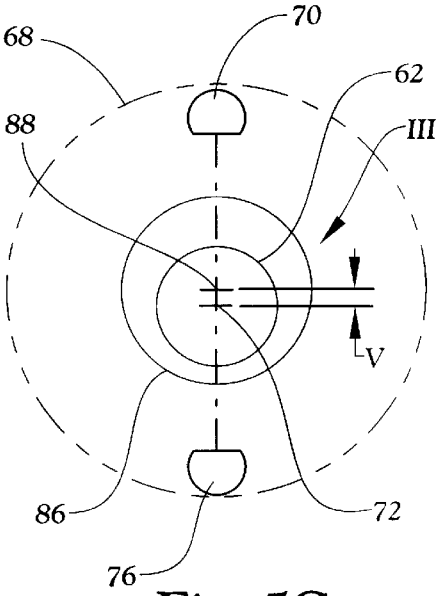
FIG. 5C is a schematic representation of a third position (position III) in the rotation of the bushing about the secondary drive shaft of FIG. 1 with respect to the main drive member and secondary drive member.
Figure 5D:
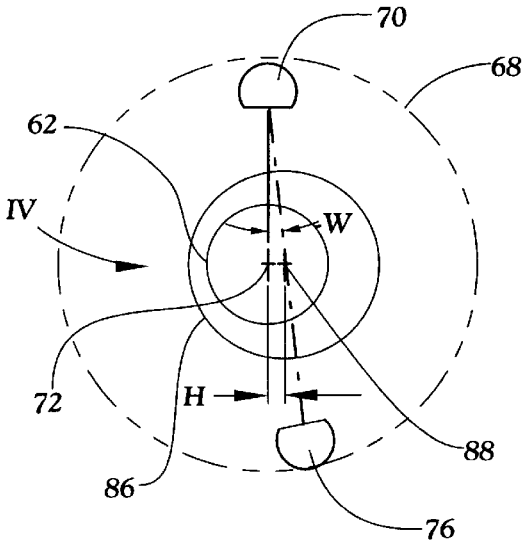
FIG. 5D is a schematic representation of a fourth position (position IV) in the rotation of the bushing about the secondary drive shaft of FIG. 1 with respect to the main drive member and secondary drive member.
Figure 6B:
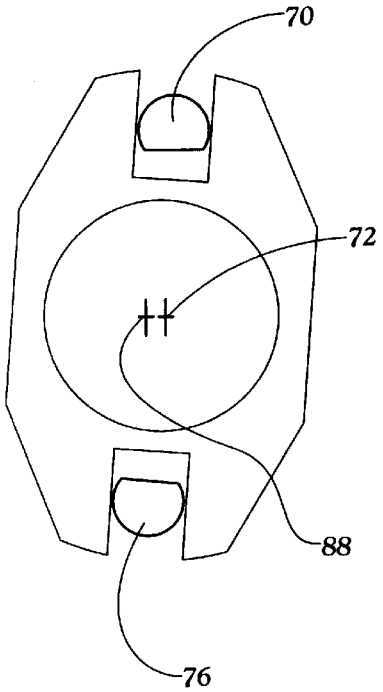
FIG. 6B is a schematic representation of the H-shaped coupling member when the bushing is in position II with respect to the main drive member and secondary drive member as shown in FIG. 5B.

In position II of the H-shaped coupling member 78 as schematically shown in FIG. 6B, the channels 82, 84 out of vertical alignment with the centerline 88 of the circular surface 86 and the main drive rod 70 and the secondary drive rod 76 are respectively disposed in channels 82, 84 approximately midway therein at essentially the same radial spacing from the centerline 88 of the circular surface 86 and the H-shaped coupling member 78 is pivoted about the main drive rod 70 by an angle $\omega$ from the vertical, with such pivoting movement of the H-shaped coupling member 78 in turn causing clockwise movement of the secondary drive rod 76 along an arcuate path with respect to the rotational axis 72 of the secondary drive shaft 62. This moving of the secondary drive rod 76 clockwise as shown in FIGS. 5B, 6B causes the secondary drive shaft 62 to moveby a corresponding arcuate distance (same angle of rotation $\omega$), which in turn causes the looptaker to move an arcuate distance.

Figure 6C:
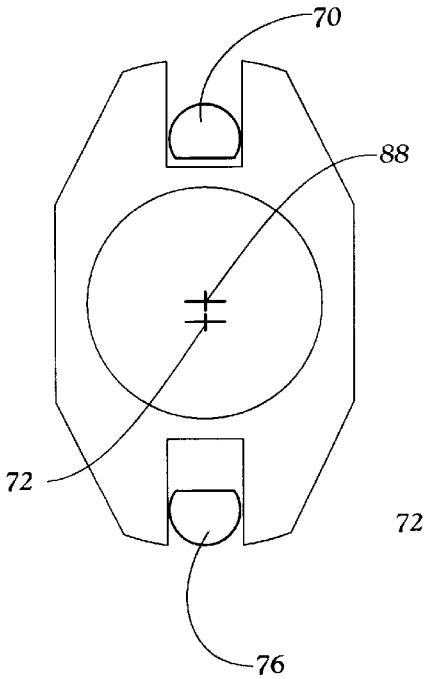
FIG. 6C is a schematic representation of the H-shaped coupling member when the bushing is in position III with respect to the main drive member and secondary drive member as shown in FIG. 5C.

In position III of the H-shaped coupling member 78 as schematically shown in FIG. 6C, the main drive rod 70 is disposed in channel 82 at its closest radial spacing to the axial centerline 88 of the circular surface 86 with the secondary drive rod 76 disposed in channel 84 at its greatest radial spacing from the axial centerline 88 of the circular surface 86 as shown in FIG. 8; this orientation of the drive rods 70, 76 with respect to the channels 82, 84 is opposite that of position I. Again, the channels 82, 84 vertically align with the axial centerline 88 of the circular surface 86. Thus, rotation of the bushing 80 from position II to position III causes the H-shaped coupling member 78 to be pivoted about main drive rod 70 back to the vertical position, thereby rotating secondary drive shaft 62 and the looptaker 52 back to their respective orientations of position I.

Figure 6D:
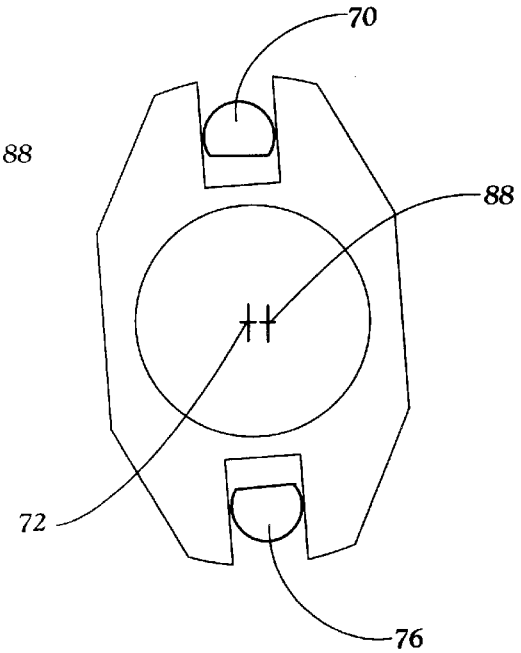
FIG. 6D is a schematic representation of the H-shaped coupling member when the bushing is in position IV with respect to the main drive member and secondary drive member as shown in FIG. 5D.

In position IV of the H-shaped coupling member 78 as schematically shown in FIG. 6D, the main drive rod 70 and the secondary drive rod 76 are again disposed in channels 82, 84 respectively midway therein at corresponding spacings from the axial centerline 88 of the circular surface 86. The channels 82, 84 are again out of vertical alignment with the axial centerline 88 of the circular surface 86, but in this position, the H-shaped coupling member 78 has been pivoted about the main drive rod 70 by rotation of the bushing 80 through a negative angle ($-\omega$) opposite to the angle in position II, with this negative pivoting movement of the H-shaped coupling member 78 causing negative movement of the secondary drive rod 76 along an opposite, counterclockwise arcuate path to that of position II. In turn, this movement of the secondary drive rod 76 causes the secondary drive shaft 62 to move a corresponding opposite arcuate distance by the same angle of rotation $-\omega$, which causes the looptaker to move an opposite arcuate distance to that moved when the bushing 80 is rotated from position I to position II.

Rotation of the bushing 80 a full revolution (i.e., from starting position I through position IV) returns the H-shaped coupling member 78, secondary drive shaft 62, and looptaker 52 back to their respective orientations found in position I. Continued rotation of the bushing 80 results in oscillation of the secondary drive rod 76 along the arcuate path corresponding to a total angle of 2ω during each revolution of the bushing 80.

The positioning effected by the looptaker driving arrangement 10 may thus be understood. During the sewing operation, the bushing 80 is rotated relative to the secondary drive shaft 62 about its rotational axis 72 (as hereinafter explained), which causes the above described movements of the H-shaped coupling member 78 and, in turn, which causes the secondary drive rod 76 to move back and forth along an arcuate path defined by the angle 2ω. Thus, the looptaker 52, which otherwise would be driven at the constant angular speed of the main drive rod 70, is angularly accelerated and angularly decelerated by the movement of the secondary drive rod 76 closer to and further from the main drive rod 70 in the clockwise direction, which results from rotation of the bushing 80 about the rotational axis 72 relative to the secondary drive rod 62. (If the bushing 80 were to rotate about the rotational axis 72 at the same angular speed as the main drive rod 70, then the main drive rod 70, secondary drive rod 76, and rotational axis 72 would be in constant alignment, the H-shaped coupling member 78 would not be pivoted about the main drive rod 70 and no angular acceleration or angular deceleration of the looptaker 52 would occur absent angular acceleration or angular deceleration of the main drive rod 70).

It will thus be apparent to one of ordinary skill in the art that in order to move the looptaker 52 from a first laterally shifted loop-seizing position to the other laterally shifted loop-seizing position and then back again as discussed above, which corresponds to two revolutions of the main drive shaft 30 and four revolutions of the main drive rod 70, the bushing 80 must pass from a first position (either position II or IV) through all of the other positions and then back to the starting position relative to the main drive rod 70.

In order to accomplish this rotation of the bushing 80 about the rotational axis 72 relative to the main drive rod 70, the present invention preferably includes a gear arrangement 90 of four gears: first and second gears 92, 94 supported by the secondary drive shaft 62 and a pair of gears 98, 100 connected together and rotatably mounted on the sewing machine frame 14. In particular, the first gear 92 is fixedly mounted in coaxial relation to the secondary drive shaft 62 for concurrent rotation therewith about the rotational axis 72. The second gear 94 is fixedly mounted to an extension 95 of the bushing 80 which itself is rotatably mounted concentrically on the secondary drive shaft 62 in coaxial relation thereto for rotation about the rotational axis 72 thereof, whereby rotation of second gear 94 therefore rotates bushing 80 about the rotational axis 72. The pair of gears 98, 100 are mounted on a support shaft 102 which, in turn, is mounted to the sewing machine frame 14 with a conventional bracket mount 104, with the gear 98 in meshing engagement with the first gear 92 and the gear 100 in meshing engagement with the second gear 94.

In operation of the gear arrangement 90, rotation of the drive pulley 68 and its integral drive rod 70 effects rotation of the secondary drive shaft 62 and the first gear 92 fixed thereto which, in turn, acts on the gear pair 98, 100 to drive rotation of gear 94 and bushing 80 about rotational axis 72. Hence, rotation of the drive pulley 68 and the main drive rod 70 results in angular accelerated and decelerated rotation of the secondary drive member 76 about the constant angular speed of the main drive rod 70, which results in the desired angular acceleration and deceleration, and thus positioning, of the looptaker 52. In particular, four complete revolutions of the main drive rod 70, the first gear 92, and the H-shaped coupling member 78 relative to the sewing machine frame 14 preferably results in three full revolutions of the second gear 94 and bushing 80 relative to the sewing machine frame 14. Thus, four complete revolutions of the main drive rod 70, first gear 92, secondary drive shaft 62, and H-shaped coupling member 78 relative to the sewing machine frame 14 results in one complete revolution of the second gear 94 and bushing 80 relative to the main drive rod 70, first gear 92, secondary drive shaft 62, and H-shaped coupling member 78.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An arrangement for driving a looptaker in a sewing machine, comprising:

a. a drive shaft rotatable about an axis thereof for driving rotation of a looptaker of the sewing machine;

b. a main drive member supported on said drive shaft for rotation about said rotational axis thereof, c. a secondary drive member fixedly mounted to said drive shaft for concurrent rotation therewith; and d. a coupling member supported on said drive shaft for rotation about said rotational axis thereof, said coupling member engaging said main drive member and engaging said secondary drive member for coupling movement of said main drive member with said secondary drive member;

whereby rotation of said main drive member about said drive shaft axis acts via said coupling member to drive rotation of said secondary drive member and said drive shaft about said drive shaft axis thereby driving rotation of the looptaker.

2. A looptaker driving arrangement according to claim 1, wherein said drive shaft is located underneath a bed of the sewing machine.

3. A looptaker driving arrangement according to claim 1, wherein said coupling member is H-shaped having two opposed channels, said main drive member being received in a first of said channels and said secondary drive member being received in a second of said channels.

4. A looptaker driving arrangement according to claim 1, wherein said coupling member is disposed in slidable and pivotable engagement with each of said main drive member and said secondary drive member.

5. A looptaker driving arrangement according to claim 1, further including a bushing mounted on said drive shaft for rotation about said drive shaft axis and having a peripheral surface eccentric to said drive shaft, said coupling member being rotatably mounted on said peripheral surface of said bushing.

6. A looptaker driving arrangement in a sewing machine, comprising:

a. a drive shaft rotatable about an axis thereof for driving rotation of a looptaker of the sewing machine;

b. a main drive member supported on said drive shaft for relative movement thereto and for rotation about said rotational axis thereof;

c. a secondary drive member fixedly mounted to said drive shaft for concurrent rotation therewith;

d. a bushing mounted on said drive shaft in eccentric axial relation thereto for rotation about said rotational axis of said drive shaft relative to said drive shaft;

e. a coupling member mounted on said bushing for rotation thereabout, said coupling member engaging said main drive member and engaging said secondary drive member for coupling movement of said main drive member with said secondary drive member;

whereby rotation of said main drive member about said drive shaft axis causes rotation of said secondary drive member and said drive shaft about said drive shaft axis thereby driving rotation of the looptaker.

7. A looptaker driving arrangement according to claim 6, wherein said coupling member is H-shaped having opposed channels formed therein, said H-shaped coupling member receiving said main drive member in a first channel in slidable and pivotable abutment therewith and receiving said secondary drive member in a second said channel in slidable and pivotable abutment therewith.

8. A looptaker driving arrangement according to claim 6, further comprising a gear arrangement for driving rotation of said bushing about said rotational axis of said drive shaft relative to said drive shaft, including i. a first gear fixedly mounted in coaxial relation to said drive shaft for concurrent rotation therewith;

ii. a pair of gears rotatably mounted on a frame of the sewing machine and joined together in coaxial relation for concurrent rotation therebetween, a first gear of said pair meshingly engaging said first gear mounted to said drive shaft; and iii. a second gear fixedly connected to said bushing and supported in coaxial relation on said drive shaft for rotation about said drive shaft axis, said second gear meshingly engaging a second of said pair of gears, said first gear thereby driving rotation of said bushing about said drive shaft axis relative to said drive shaft, said looptaker being angularly accelerated and decelerated by pivoting of said coupling member about said main drive member by rotation of said bushing about said drive shaft axis relative to said drive shaft.

9. A looptaker driving arrangement according to claim 8, wherein four complete revolutions of said first gear about said drive shaft axis relative to the sewing machine results in three complete revolutions of said second gear about said drive shaft axis relative to the sewing machine.

10. A looptaker driving arrangement in a sewing machine, comprising:

a. a main drive shaft and a first pulley fixedly mounted thereto;

b. a secondary drive shaft rotatable about a longitudinal axis thereof for driving rotation of a looptaker of the sewing machine;

c. a second pulley rotatably supported on said secondary drive shaft for rotation about said rotational axis of said secondary drive shaft;

d. an endless pulley belt connecting said second pulley to said first pulley;

e. a main drive rod fixedly mounted to said second pulley and rotatable about said rotational axis of said secondary drive shaft;

f. a secondary drive rod fixedly supported by said secondary drive shaft for rotation therewith about said rotational axis thereof;

g. a bushing rotatably mounted on said secondary drive shaft for rotation about said rotational axis of said secondary drive shaft relative to said drive shaft, said bushing having a circular surface with a center offset from said rotational axis of said secondary drive shaft;

h. an H-shaped coupling member having opposed channels formed therein, said H-shaped coupling member being rotatably mounted on said circular surface of said bushing for rotation about said offset center thereof, said H-shaped coupling member being rotatable about said rotational axis of said secondary drive shaft by said rotation of said bushing thereabout, said H-shaped coupling member receiving said main drive rod in a first channel in slidable and pivotable abutment therewith and receiving said secondary drive rod in a second said channel in slidable and pivotable abutment therewith; and i. a gear arrangement for driving rotation of said bushing about said rotational axis of said secondary drive shaft relative to said secondary drive shaft, including i. a first gear fixedly mounted in coaxial relation to said secondary drive shaft for rotation therewith;

ii. a pair of gears rotatably mounted on a frame of the sewing machine and joined together in coaxial relation for concurrent rotation, a first gear of said pair meshingly engaging said first gear mounted to said secondary drive shaft; and iii. a second gear fixedly connected to said bushing and mounted on said secondary drive shaft in coaxial relation thereto for rotation about said secondary drive shaft axis relative to said drive shaft, said second gear meshingly engaging a second of said pair of gears, said first gear mounted to said secondary drive shaft thereby driving rotation of said bushing about said secondary drive shaft axis relative to said secondary drive shaft upon rotation of said secondary drive shaft;

whereby said looptaker is angularly accelerated and decelerated by pivoting of said H-shaped coupling member about said main drive rod by rotation of said bushing about said secondary drive shaft axis relative to said secondary drive shaft.

11. A looptaker driving arrangement in a sewing machine, comprising:

means for moving a hook of a looptaker to an angular position forward of a neutral needle reciprocating path and for moving the hook of the looptaker to an angular position rearward of the neutral needle reciprocating path, said moving means being disposed for rotation about an axis of rotation of a drive shaft which drives rotation of the looptaker; and means for controlling the moving means for timing the positioning of the hook of the looptaker with respect to lateral shifting movements of a needle forwardly and rearwardly relative to the neutral needle reciprocating path.

12. A looptaker driving arrangement according to claim 11, wherein said moving means includes:

i. a drive shaft rotatable about an axis thereof for driving rotation of a looptaker of the sewing machine;

ii. a main drive member rotatably supported on said drive shaft for rotation about said rotational axis thereof relative to said drive shaft;

iii. a secondary drive member fixedly mounted to said drive shaft for concurrent rotation therewith;

iv. a bushing rotatably mounted on said drive shaft for rotation about said rotational axis thereof relative to said drive shaft, said bushing having a peripheral surface eccentric to said drive shaft; and v. a coupling member rotatably mounted on the peripheral surface of said bushing in eccentrial axial relation to said drive shaft for eccentric axial rotation about said drive shaft axis, said coupling member engaging said main drive member and engaging said secondary drive member for coupling movement of said main drive member with said secondary drive member;

whereby rotation of said bushing causes said coupling member to pivot in oscillating manner about said main drive member thereby causing said secondary drive member to oscillate in an arcuate path about said drive shaft axis.

13. A looptaker driving arrangement according to claim 12, wherein said control means includes a gear arrangement having:

a. a first gear fixedly mounted to said drive shaft in coaxial relation thereto;

b. a pair of gears rotatably mounted on a frame of said sewing machine; and c. a second gear rotatably supported on said drive shaft in coaxial relation therewith and fixedly connected to said bushing for concurrent rotation therewith;

wherein said first gear meshingly engages a first one of said pair of gears and said second gear meshingly engages a second one of said pair of gears, said pair of gears being fixedly joined together for simultaneous rotation.

14. A looptaker driving arrangement according to claim 13, wherein four complete revolutions of said first gear about said drive shaft axis relative to the sewing machine results in three complete revolutions of said second gear about said drive shaft axis relative to the sewing machine.

15. A method of moving a hook of a looptaker of a sewing machine to an angular position forward of a neutral needle reciprocating path and for moving the hook to an angular position rearward of the neutral needle reciprocating path, comprising:

a. providing i. a drive shaft rotatable about an axis thereof for driving rotation of a looptaker of the sewing machine;

ii. a main drive member supported on the drive shaft for relative movement thereto and for rotation about the rotational axis thereof, iii. a secondary drive member fixedly mounted to the drive shaft for concurrent rotation therewith;

iv. a bushing mounted on the drive shaft in eccentric axial relation thereto for rotation about the rotational axis of the drive shaft relative to the drive shaft; and v. a coupling member mounted on the bushing for rotation thereabout, the coupling member engaging through abutment the main drive member and engaging through abutment the secondary drive member for coupling movement of the main drive member with the secondary drive member; and b. rotating the bushing about the drive shaft axis relative to the drive shaft.

16. A method according to claim 15, further including rotating the main drive member about the axis of the drive shaft for further driving rotation of the secondary drive member via the coupling member.

17. A method according to claim 16, wherein the bushing is rotated three times about the drive shaft axis relative to the sewing machine each time the main drive member is rotated four times about the drive shaft axis relative to the sewing machine.

18. A method according to claim 16, wherein the bushing is rotated one time about the drive shaft axis relative to the first drive member each time the first drive member is rotated four times about the drive shaft axis relative to the sewing machine.

* * * * *